US006508080B1

(12) United States Patent
Ninomiya

(10) Patent No.: US 6,508,080 B1
(45) Date of Patent: Jan. 21, 2003

(54) CLASP FOR JEWELRY AND ACCESSORY

(75) Inventor: Tomoyasu Ninomiya, Tokyo (JP)

(73) Assignee: Seberupico Corporation, Tokyo (JP)

( * ) Notice: Subject to any disclaimer, the term of this patent is extended or adjusted under 35 U.S.C. 154(b) by 0 days.

(21) Appl. No.: 09/569,048

(22) Filed: May 10, 2000

(51) Int. Cl.[7] ..... A44C 5/00

(52) U.S. Cl. ..... 63/3.1; 63/8; 63/14.5; 24/574.1; 24/587.11

(58) Field of Search ..... 63/3.1, 14.4, 14.5, 63/4, 7, 8; 24/206.3, 574.1, 587.11, 629, 631, 633, 643, 644, 647, 662, 664

(56) References Cited

U.S. PATENT DOCUMENTS

| | | | | |
|---|---|---|---|---|
| 183,164 | A | * 10/1876 | Hessels | |
| 402,071 | A | * 4/1889 | Doran et al. | |
| 408,308 | A | * 8/1889 | Keller | |
| 492,222 | A | * 2/1893 | Molloy | |
| 517,421 | A | * 4/1894 | Adams | |
| 1,061,076 | A | * 5/1913 | Hilditch | |
| 1,152,892 | A | * 9/1915 | Henry | |
| 1,193,111 | A | * 8/1916 | Breidenbach | |
| 1,350,945 | A | * 8/1920 | Stockdale | |
| 1,683,545 | A | * 9/1928 | Harris | |
| 1,974,455 | A | * 9/1934 | Gaspari | |
| 2,051,591 | A | * 8/1936 | Brogan | |
| 2,667,675 | A | * 2/1954 | Brutti | |
| 2,713,445 | A | * 7/1955 | Speck | |
| 2,856,661 | A | * 10/1958 | Holl | |
| 2,896,288 | A | * 7/1959 | Davis | |
| 3,040,406 | A | * 6/1962 | Artzt | |
| 3,402,438 | A | * 9/1968 | Battistello | |
| 3,765,064 | A | * 10/1973 | Hoober et al. | 24/211 |
| 4,364,155 | A | * 12/1982 | Synowicki | 24/217 R |
| 4,411,050 | A | * 10/1983 | Couture | 24/234 |
| 4,425,687 | A | * 1/1984 | Sauer | 24/664 |
| 4,466,162 | A | * 8/1984 | Pogharian et al. | 24/585 |
| 4,562,625 | A | * 1/1986 | Doty et al. | 24/640 |
| 4,924,562 | A | * 5/1990 | Pogharian | 24/647 |
| 5,138,855 | A | * 8/1992 | Faris | 70/457 |
| 5,257,512 | A | * 11/1993 | Febrer | 63/4 |
| 5,351,505 | A | * 10/1994 | Febrer | 63/2 |
| 5,628,095 | A | * 5/1997 | Appel et al. | 24/575 |
| 6,134,917 | A | * 10/2000 | Kohl et al. | 63/12 |
| 6,138,475 | A | * 10/2000 | Kohl et al. | 63/12 |

FOREIGN PATENT DOCUMENTS

| | | |
|---|---|---|
| JP | 9-191912 | * 7/1997 |
| JP | 10-262715 | * 10/1998 |
| JP | 2000139527 | * 5/2000 |

* cited by examiner

*Primary Examiner*—Anthony Knight
*Assistant Examiner*—Alison K. Pickard
(74) *Attorney, Agent, or Firm*—Wenderoth, Lind & Ponack, L.L.P.

(57) ABSTRACT

A connecting device for jewelry and accessories includes a male member formed as a pole having a tapered head, a groove on the surrounding surface at the bottom end, and having a connecting portion for connecting to jewelry and accessories at the end. A female member formed as an open and close box, includes a cover having a half-circle insertion aperture for the male member at one side in the longitudinal direction with or without a guide cylinder or a guide wall, and includes a base having a hook-recess of the said groove of the male member. A connecting portion for connecting to jewelry and accessory is provided at the end of the base. The box is made so that a shaft penetrates the cover and the base, and a spring member biases the cover and the base in the closing direction.

14 Claims, 15 Drawing Sheets

CLASP FOR JEWELRY AND ACCESSORY

BACKGROUND OF THE INVENTION

1. Field of the Invention

This invention relates to a connecting device which is used for jewelry and accessories, such as a pearl necklace, and a chain necklace.

2. Description of the Prior Art

A connecting device which is used for jewelry and accessories such as a pearl necklace, as shown in FIG. 1, is conventionally known as a clasp. For instance, a clasp 20 comprises a female member 21, which is a box having a insertion aperture 22, and male member 26 made of a metal plate bent into a V-shape and formed as a plate-spring. It is used by inserting or pulling out the male member 26, formed into a flat shape by using the fingers to press portion 27 against the back portion, into the aperture of the female member 21.

However, the above-mentioned clasp 20 has a disadvantage in that it is difficult to wear. For instance, it is often necessary to move the clasp 20 to the front of the neck to confirm that the male member 26 is surely connected to the female member 21, and then to move the clasp back behind the neck when the necklace is used. Furthermore, it is not easy to form the male member 26 to a flat shape by pressing portion 28 using the fingers, and portion 28 must be inserted into the aperture 22 and surely hooked in the hook-recess 23.

Another example, as shown in FIG. 2, is a connecting device 30 with a coiled spring which solved the above problem of operating difficulties (Japan Utility Patent Publication No. H7-30730). This example includes a male member 31 formed as around-bar shape having a connecting groove 32 on the surrounding surface, and a female member 35 formed as a cylinder having a hook frame 37 movable in the up-down direction. Pushing button 38 and coil-spring 36*a* are also arranged in female member 35. The coil-spring 36*a* biases the hook frame 37 in the direction of the connecting groove 32 of the male member 31 when the male member 31 is inserted in. Therefore, the connecting groove 32 is hooked by the hook frame 37, so that the male member 33 is connected to the female member 35. Also, the connection is released when the push button 38 is pushed downwards by a finger, so that the male member 31 is able to be pulled out from the female member 35.

However, the connecting device 30 requires a certain size coil spring 36*a* to prevent a reduction in elastic power after long time use. Therefore, the size of connecting device 30 is not able to be minimized. Moreover, the connecting device 30 has a problem in that it is not easy to be constructed because it has many small parts, and the cost of the connecting device 30 becomes very expensive as a part used for jewelry and accessories.

SUMMARY OF THE INVENTION

It is therefore an object of the present invention to provide a connecting device for jewelry and accessories which is capable of eliminating the above-mentioned problems, which is easy to wear, and which is constructed of only a few small parts so that the cost is very reasonable.

For this purpose, in accordance with the present invention, a connecting device for jewelry and accessories comprises a male member formed as a pole having a taper-like head, a groove on the surrounding surface of the bottom, and a connecting portion for connecting the device to jewelry and accessories at the end. The device also comprises a female member formed as an open and close box. The female member includes a cover with or without a guide cylinder or a guide wall having a half-circle inserting aperture for insertion of the male member at one side in the longitudinal direction, a base having a hook-recess for the groove of the male member, and a connecting portion to connect to jewelry and accessories at the end. The box is made so that an axis penetrates the cover and the base, and so that a spring member biasing the cover and the base in the closing direction is installed.

BRIEF DESCRIPTION OF THE DRAWINGS

The object and features of the present invention will become more readily apparent from the following detailed description of the preferred embodiments taken in conjunction with the accompanying drawings, in which.

DESCRIPTION OF THE INVENTION

Embodiments of this invention will be described hereinafter with references to FIG. 30.

Figure 1:
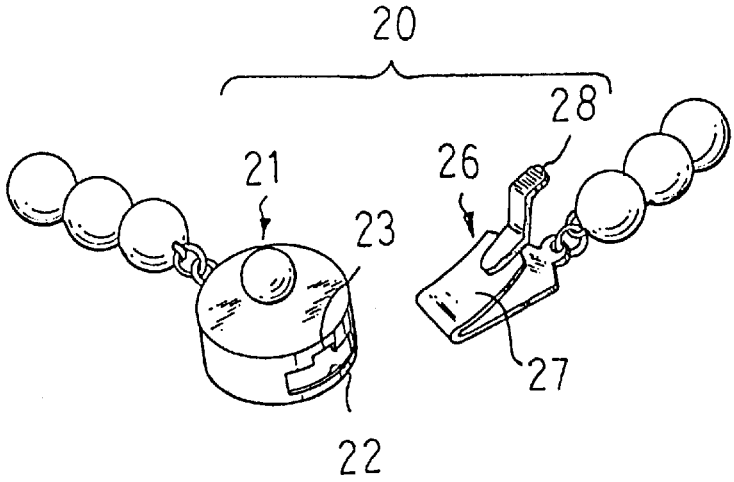
PRIOR ART FIG. 1
FIG. 1 is a perspective view showing one example of a clasp for jewelry and accessories in the prior art.
Figure 2:
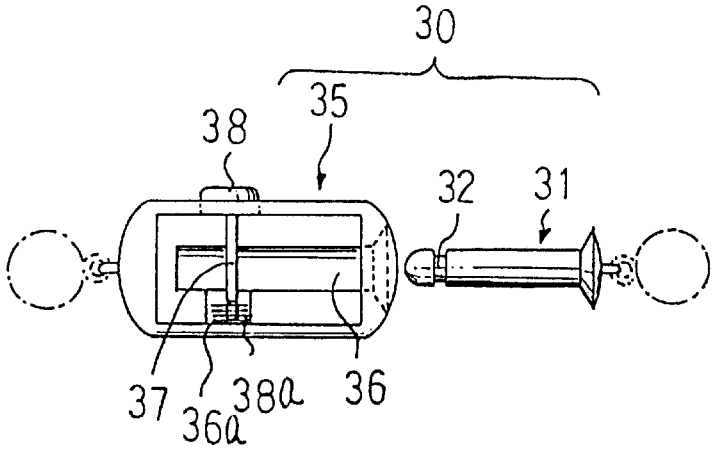
PRIOR ART FIG. 2
FIG. 2 is a side view showing a connecting device for jewelry and accessories in the prior art.
Figure 3:
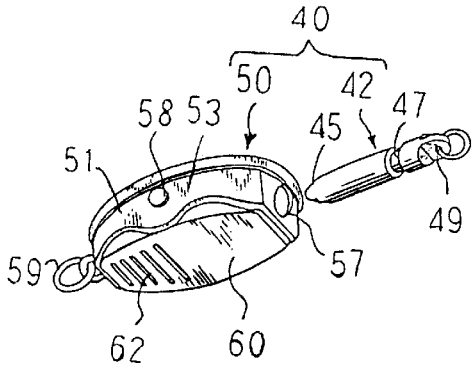
FIG. 3 is a perspective view showing a first embodiment of this invention.
Figure 4:
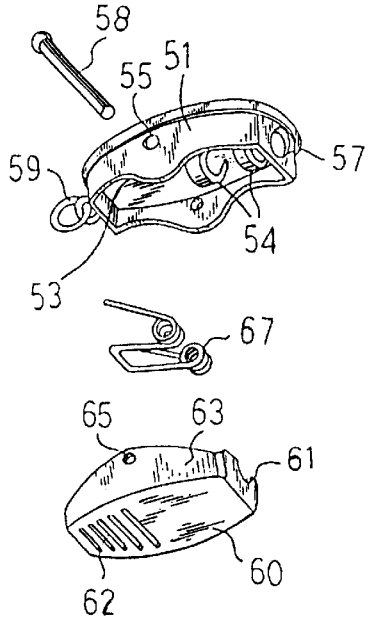
FIG. 4 is a perspective view showing the parts of the male member of the first embodiment of this invention.
Figure 5:
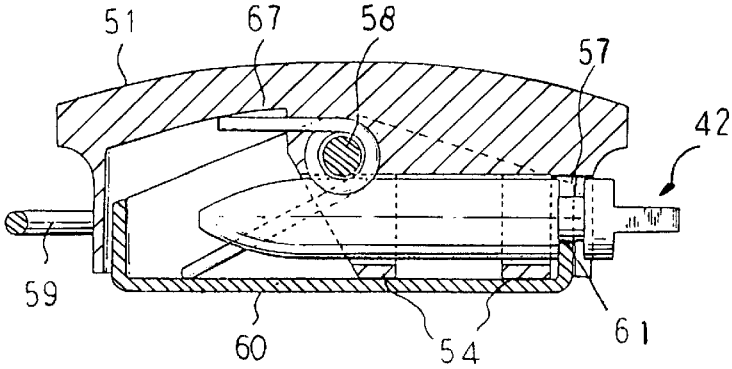
FIG. 5 is a cross sectional side view showing the connection of the male member and the female member of the first embodiment of this invention.

FIG. 3 is a perspective view showing the first embodiment of this invention, FIG. 4 a perspective view showing the parts of the male member of the first embodiment of this invention, and FIG. 5 is a cross sectional side view showing the connection of the male member and the female member of the first embodiment of this invention.

A connecting device 40 for jewelry and accessories includes a male member 42 having a pole shape, and a female member 50 formed as an open-close box. The male member 42 and the female member 50 are each connected to an end of jewelry and accessories such as a pearl necklace, or a necklace chain.

The male member 42 comprises a head 45 at the end point, and the head is formed by curving the pole in a taper shape. A groove 47 is formed at the bottom by, for example, cutting the surrounding surface of the pole. A connecting portion 49 is formed at the end as, for example, a plate with an open-hole 49 by pressing, and a ring-shaped connecting portion is linked to the open-hole. A string of, for example, pearl beads of a pearl necklace, is fastened to the connecting portion.

The female member 50 comprises a cover 51, which is opened at the entire undersurface of a rectangular-shaped box, and a base 60, which is opened at the entire upper surface of a rectangular-shaped box. The box 51 and base 60 fit each other and embody an open-close box because they have the same dimensions and shapes.

An insertion aperture 57 having a round shape is formed at one end wall of the cover 51 in the longitudinal direction, and the internal diameter of the aperture 57 is formed a little bigger than the outer diameter of the above-mentioned male member 42.

Two small guide cylinders 54 having nearly the same diameter of the insertion aperture 57 are formed on the internal upper face of the cover 51, and the guide cylinders are lined up on the same axis as the insertion aperture 57. Two projections 53 are formed by extending the side walls of the cover 51 downward, and through-holes 55 for the axle 58 are formed in both projections 53. A connection portion 59 is formed at the opposite side of the cover from the insertion aperture 57.

A hook recess 61 having the same diameter as the groove 47 of the male member 42 (i.e., a little smaller diameter than the outer diameter of the male member 42) is formed as a half circle shape at one end wall of base 60 in the longitudinal direction. A press portion 62 having an uneven surface is formed on the bottom surface of the base 60, and this surface prevents fingers from sliding when the base 60 is pushed. Slopes inclining gently are formed in the side walls of the base 60, and through-holes 65 for the axle 58 are also formed in the side walls. Due to the slope in the sidewalls, through-holes 65 are located at a position above the top of each end wall of the base 60, as shown in FIG. 5. The through-holes 55 and 65 of the cover 51 and the base 60 are aligned by being penetrated with the axle 58 so that an open-close box is formed. Also, a coiled spring 67 having ends at both sides bent upward approximately 90 degrees is installed inside the open-close box by a middle hole of the coiled spring 67 being penetrated by the axle 58.

In this state, both ends of the coiled spring 67 push the cover 51 upwards and the middle u-part of the coiled spring 67 pushes the base 60 downwards so that the female member 50 is biased in a closing direction. In addition, the female member 50 is openable by pushing the press portion 62 of the base 60.

In this embodiment, the height of the projections 53 of the cover 51 is preferable more than 33% of the height of the side walls of the base 60. Therefore, the cover 51 is fixed to the base 60 with stability when the open-close box is opened and closed.

In order to use the connecting device 40, the head 45 of the male member 42 is pushed through the insertion aperture 57 and is inserted smoothly because of the form of the tapered-like shape. By being guided the guiding cylinders 54, the male member 42 proceeds deep into the inside of the female member 50, and the surrounding surface of the male member 42 pushes the base 60 downwards. When the groove 47 of the male member 42 reaches the hook-recess 61 of the base 60, the base 60 is pushed up by the elastic power of the coiled spring 67. Then the groove 47 is hooked by the hook-recess 61 and the male member 42 is connected to the female member 50.

The through-hole 65 and axle 58 are located above the top of the end walls of base 60 due to slopes in the sidewalls. Therefore, when the press portion 62 is pushed upwards by fingers, it is easy to open the open-close box because of the slopes formed on the side walls of the base 60. When the groove 47 is released from the hook-recess 61, the male member 42 is able to be pulled out from the female member 50. The male member 42 may be manufactured by a lathe process from a metal rod, and the female member may be manufactured by assembling the cover 51 and the base 60, which are made by press cutting or by a casting process. Therefore, the connection device for jewelry and accessories 40 is manufactured easily and the cost of the product is very economical.

Figure 6:
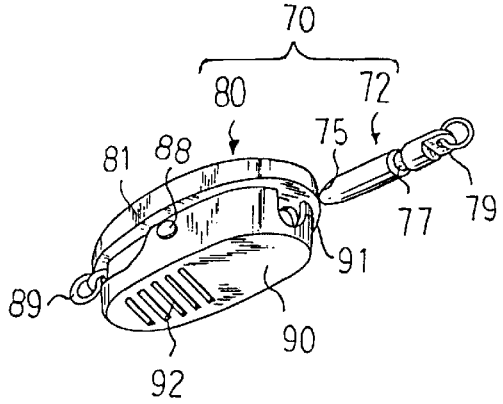
FIG. 6 is a perspective view showing a second embodiment of this invention.
Figure 7:
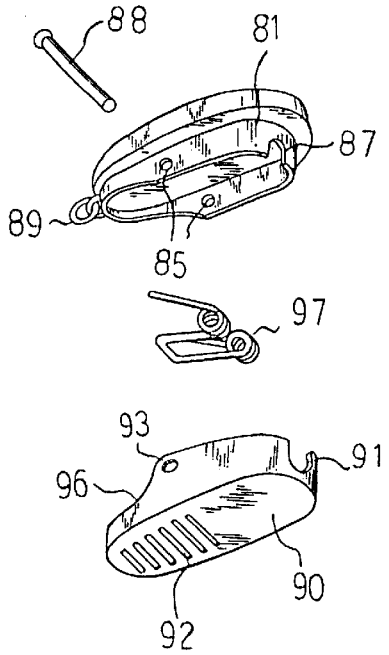
FIG. 7 is a perspective view showing the parts of the male member of the second embodiment of this invention.
Figure 8:
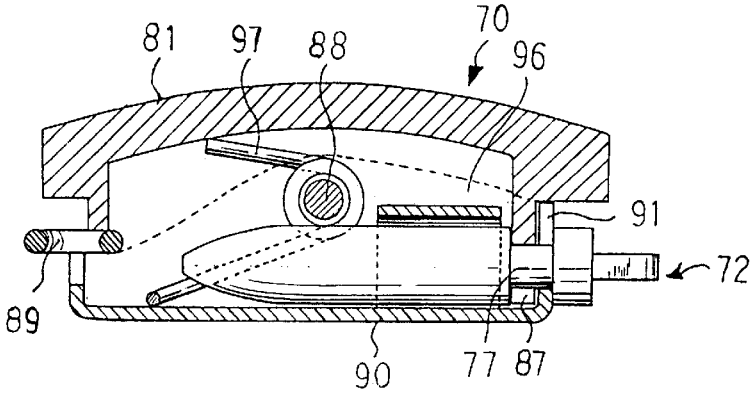
FIG. 8 is a cross sectional side view showing the connection of the male member and the female member of the second embodiment of this invention.

FIG. 6 is a perspective view showing a second embodiment of this invention, FIG. 7 is a perspective view showing the parts of the female member 80 of the second embodiment of this invention, FIG. 8 is a cross sectional view showing the connection of the male member 72 and the female member 80 of the second embodiment of this invention. In this embodiment, the male member 72 is the same as the male member of the first embodiment.

A cover 81 of the female member 80 includes a first hook-recess 87 which is formed on one end wall of the cover 81 in the longitudinal direction. The internal diameter of the first hook-recess 87 is formed to be the same diameter as the groove 77 of the male member 72 (i.e., slightly smaller than the outer diameter of the main body of the male member 72). The side walls of the cover 81 slope gently so as to be inclined towards the rear end (i.e., the end opposite the first hook-recess 87), and have through-holes 85 for the axle 88.

A base 90 provides a second hook recess 91 having the same diameter of the groove 77 of the male member 72 (i.e., slightly smaller than the outer diameter of the male member 72), and is formed as a half circle shape on one end wall of base 90 in the longitudinal direction. Two small guide cylinders (as in the first embodiment) are formed on the inner bottom face of the base 90 (not shown in figures), and are lined up on the same axis as the second hook-recess 87.

A press portion 92 having an uneven surface is formed on the outer bottom surface of the base 90 (as in the first embodiment). The side walls of the base 90 slope gently so as to be inclined towards the rear end (i.e., the end opposite the second hook recess 91), and have through-holes 93 for the axle 88 located higher than the top of the rear end wall of base 90.

The cover 81 and the base 90 are attached by penetrating an axle 88 through through-holes 85 and 93 so as to form an open-close box. A coiled spring 97 is installed as in the first embodiment, and both ends of the coiled spring 97 push the cover 81 and the middle of the u-shape of the coiled spring 97 pushes the base 90.

The use of the connecting device of this embodiment is the same as in the first embodiment. In this embodiment, the groove 77 of the male member 72 is hooked by both the first hook recess 87 and the second hook recess 91. Therefore, the connection of the male member 72 and the female member 80 is more solid and reliable.

Figure 9:
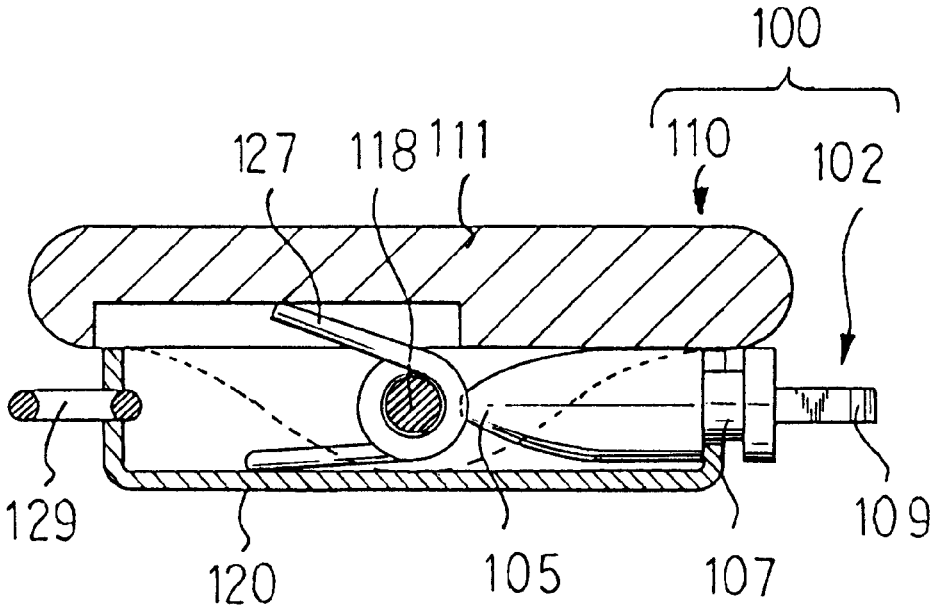
FIG. 9 is a cross sectional side view showing a third embodiment of this invention.

FIG. 9 is a cross sectional side view showing the third embodiment of this invention. In this embodiment, the male member 102 is the same as in the first embodiment.

The female member 110 comprises a cover 111 having projections 105 of angular shapes. Each of the projections has the same height as the base 120, and is formed by extending the side walls of the cover 111 downward. Through-holes for the axis are formed in the center of the projections 105 and the side walls of the base 120, and are substantially the same of the first embodiment. The through-holes can be arranged so as to be below the top of the end wall of base 120. However, the top inner surface of cover 111 includes a recess for allowing the top of the rear end wall to be raised above the bottom of cover 111.

In this embodiment, the axle 118 is placed at the same level of the insertion aperture (number not shown in FIG. 9) of the base 120. Therefore, the thickness of the connection device 100 is minimized and it is very preferable for jewelry and accessories.

Figure 10:
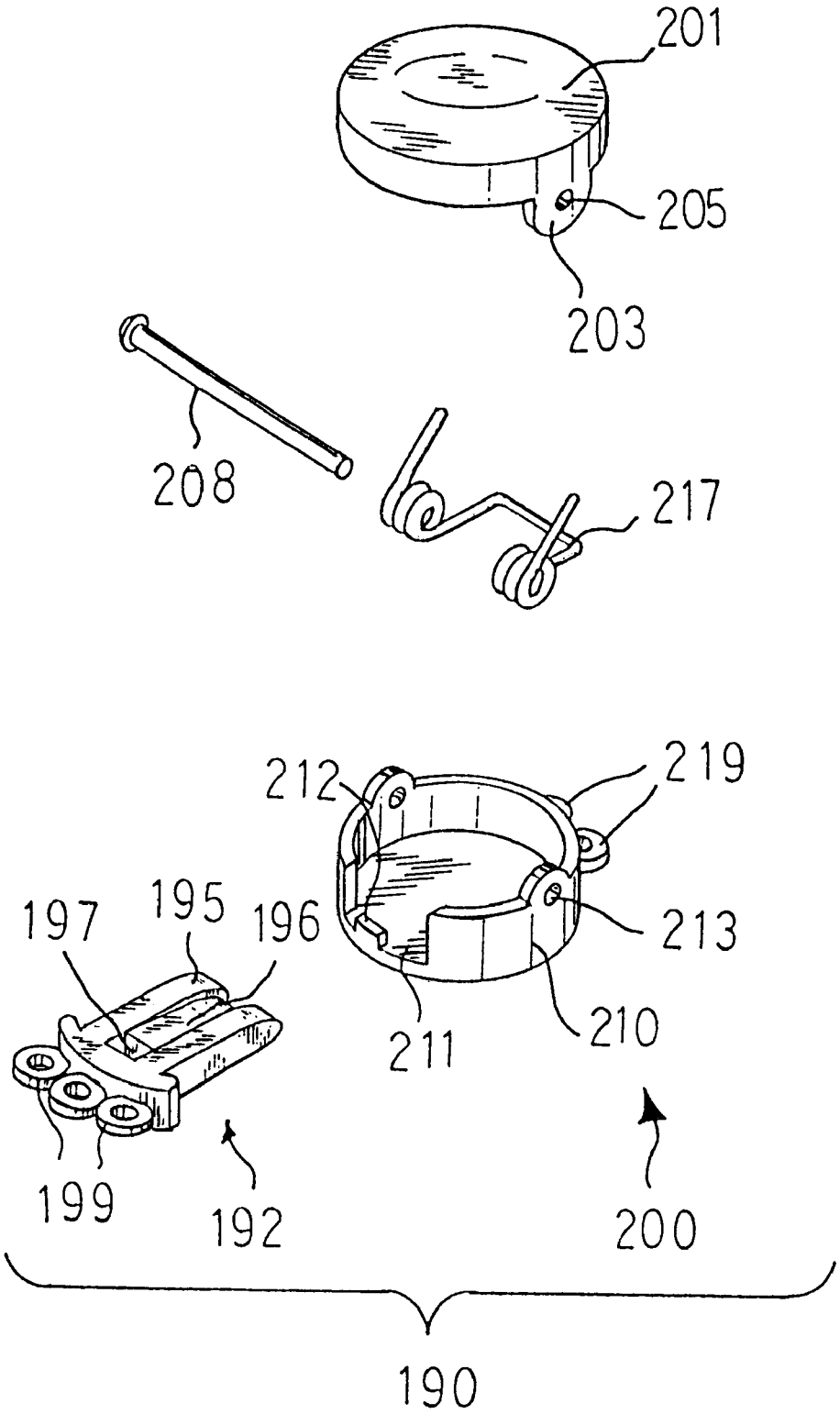
FIG. 10 is a perspective view showing the parts of a fourth embodiment of this invention.

FIG. 10 is a perspective view showing the parts of a fourth embodiment of this invention.

A connecting device 190 includes a male member 192 formed substantially as a wedge-shape having a base part with a large radius, and a female member 200 formed as a round open and close box. The male member 192 comprises a guide groove 196 in the longitudinal direction and a hook-recess 197 at the bottom in the rear of the guide groove 196. Connecting portions 199 are formed at the rear end on the base part. Each end of plural pearl necklaces or plural necklace chains are fastened to the connecting portions 199.

The female member 200 comprises a cover 201 having an undersurface with a round-shape. Projections 203 with through holes 205 extend from side walls located at opposite sides of cover 201. A base 210 having the same shape and same diameter as the cover 201 has a hook-recess 211 with a hook-protrusion 212 at the bottom center thereof The connecting device 190 is used substantially in the same manner as the above-mentioned embodiments. In this embodiment, the plural connecting portions 199, 219 are provided, so that it is usable for plural pearl necklaces or plural chains necklace. Pearl necklaces and chain-necklaces are connected with stability by this embodiment because the male member 192 has a wedge-shape and the female member 210 has a is round-shape. Therefore, the plural pearl necklaces and plural chains necklace are rarely twisted when they are worn.

Figure 11:
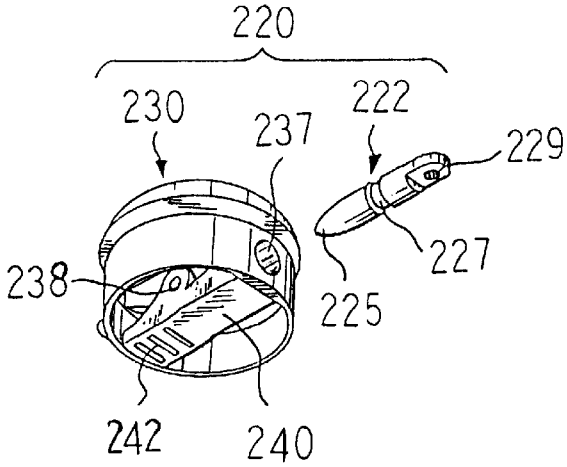
FIG. 11 is a perspective view showing a fifth embodiment of a connecting device of this invention.
Figure 12:
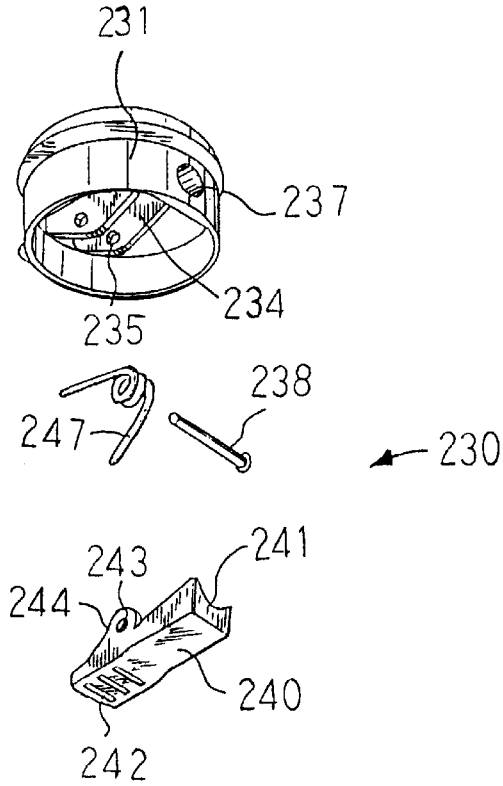
FIG. 12 is a perspective view showing the parts of the female member of the fifth embodiment.

FIG. 11 is a perspective view showing a fifth embodiment of a connecting device of this invention, and FIG. 12 is a perspective view showing the parts of the female member of this embodiment.

A connecting device 220 comprises a male member 222 formed the same as in the first embodiment, and a female member 230 which comprises a cover 231 and a hook-lever 240.

A cover 231 of this embodiment is formed as a hollow box having a round shape and having an insertion aperture 237 formed at one side of the wall. Parallel guiding walls 234 being spaced apart a gap distance equal to the outer diameter of the male member 222 are formed on the top inner surface of cover 231 and aligned with the insertion aperture 237. Also, each guiding wall 234 has through holes 235 in the center. The hook-lever 240 comprises a hook-recess 241 having a half-circle shape formed by bending the end wall of the hook lever 240 upwards about 90 degrees. Projections 244 having through holes 243 extend upwards from the slides of hook lever 240, and a press portion 242 is provided on the bottom surface as in the previous embodiments. The hook-lever 240 is attached to the cover 231 with an axle 247 and a coil-spring 247 installed in the same manner as the previous embodiments and it is pivotable between the open-close position.

The use of the connecting device 220 of this embodiment is substantially the same as the above-mentioned embodiments.

This embodiment has an advantage that the female member 230 may be easily formed as any shape since it's not necessary to make a cover and a base completely match. Consequently, more decorative shapes, for instance, a heart shape, or a star shape, may be incorporated in the connecting device 220, and this is very valuable for the parts used for jewelry and accessories.

Figure 13:
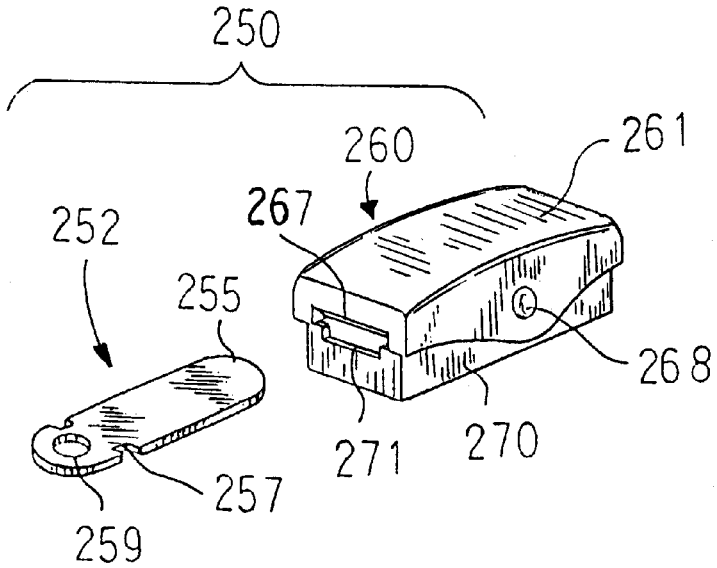
FIG. 13 is a perspective view showing a sixth embodiment of this invention.
Figure 14:
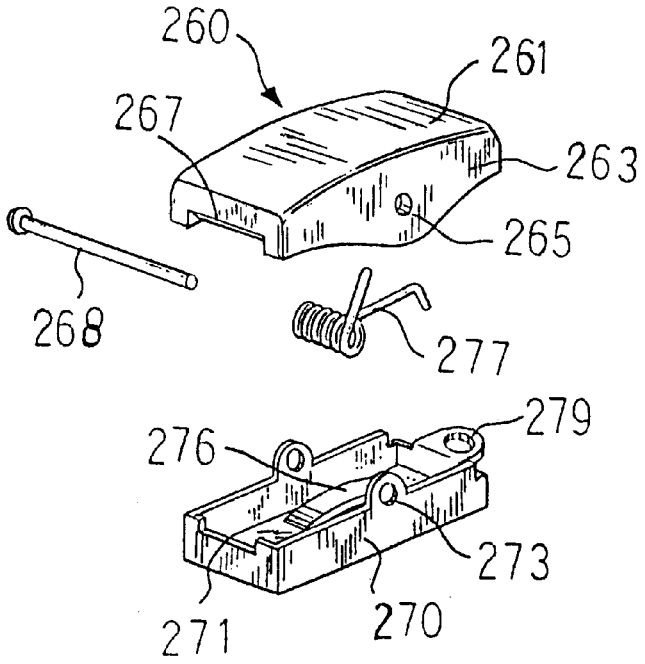
FIG. 14 is a perspective view showing the parts of the female member of the sixth embodiment of this invention.
Figure 15:
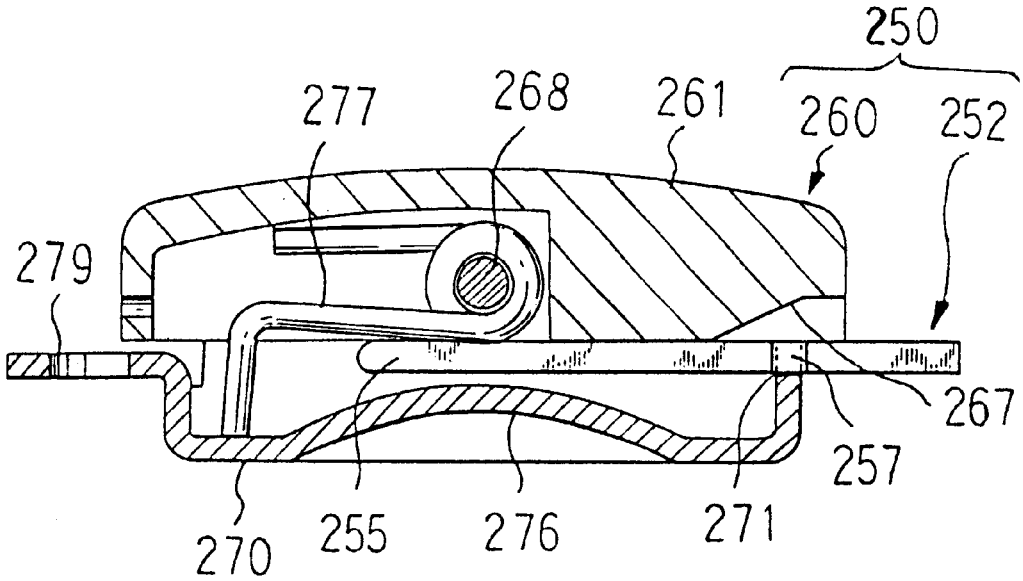
FIG. 15 is a cross sectional view showing the connection of the sixth embodiment of the male member and the female member of this invention.

FIG. 13 is a perspective view showing a sixth embodiment of this invention, FIG. 14 is a perspective view showing the parts of the female member of the sixth embodiment of this invention, and FIG. 15 is a cross sectional view showing the connection of the male member and the female member of the sixth embodiment of this invention.

A connecting device 250 includes a male member 252 formed to have a substantially plate-shape, and a female member 260 formed to have a rectangular-shape of an open and close box. The male member 252 comprises a head 255 formed as u-curve at the point, and has a hook-recess 257 of the bottom end at both sides and a connecting aperture 269 at the rear end.

The female member 260 comprises a cover 261, which is opened at the entire undersurface of the rectangular-shape, and has an insertion aperture 267 and through holes 265 formed in substantially the same manner as the above-mentioned embodiments. A base 270 which is opened at the entire upper-surface and has the same shape and size as the cover 261, also has a hook-recess 271, through holes 273 and a supporting portion 276 formed as an upwardly curving (arch) surface. The cover 261 and the base 270 are attached by the axle 268, and a coiled spring 277 is installed inside in the same manner as the above-mentioned embodiments.

The use of the connecting device 250 is substantially the same as in the above-mentioned embodiments. This embodiment may be used for a chain-necklace and the connection is very reliable because the supporting portion 276 pushes and supports the male member 252 when it is inserted.

Figure 16:
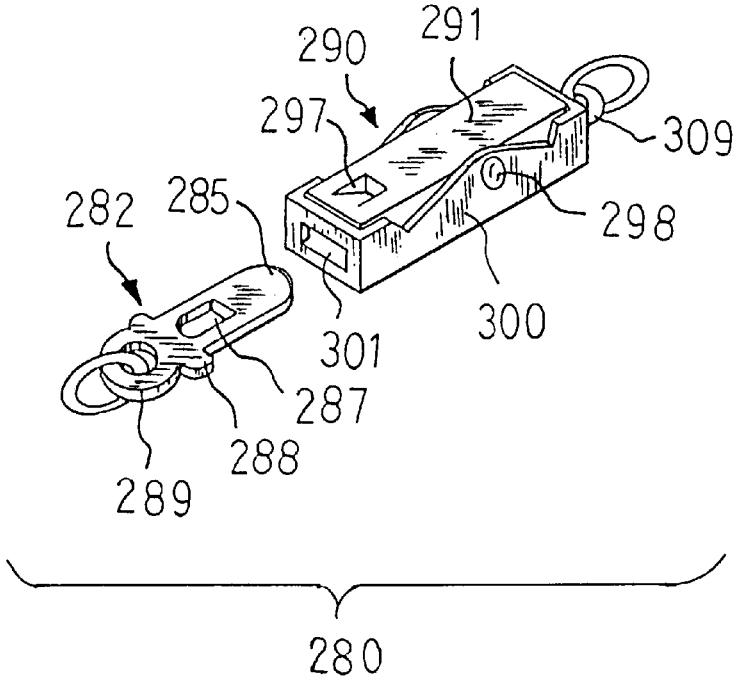
FIG. 16 is a perspective view showing a seventh embodiment of this invention.
Figure 17:
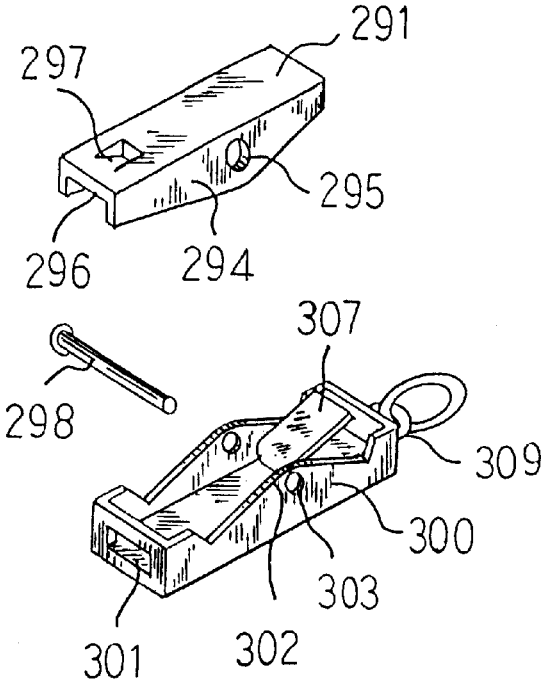
FIG. 17 is a perspective view showing the parts of the female member of the seventh embodiment of this invention.

FIG. 16 is a perspective view showing a seventh embodiment of this invention, and FIG. 17 is a perspective view showing the parts of the female member of the seventh embodiment of this invention.

As shown in FIG. 17, the type of spring is not limited to a coiled spring as described above in this invention. For example, a plate-spring 307 which is made by bending a metal plate to a v-shape is usable.

Figure 18:
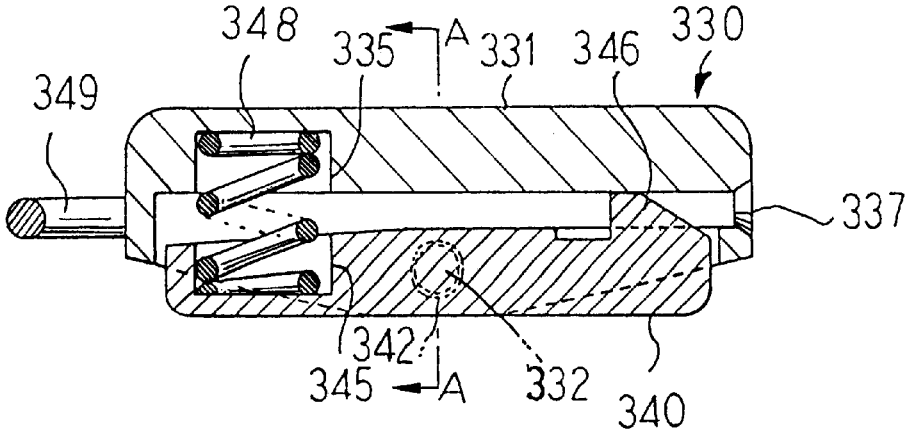
FIG. 18 is a cross sectional-side view showing an eighth embodiment of this invention.
Figure 19:
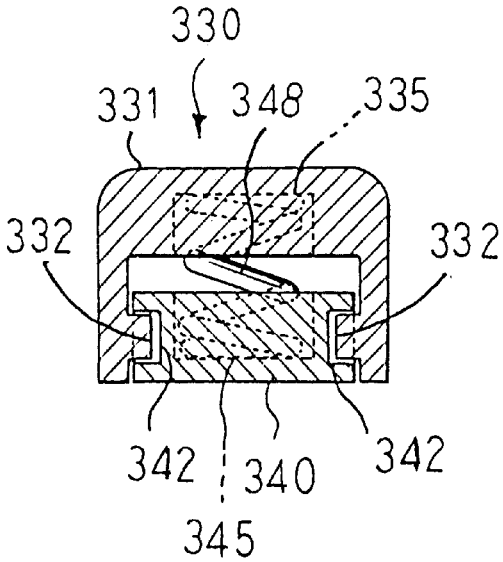
FIG. 19 is A–A' cross sectional view of the eighth embodiment of this invention.

FIG. 18 is a cross sectional-side view showing an eighth embodiment of this invention, and FIG. 19 is an A–A' cross sectional view of the eighth embodiment of this invention.

In this embodiment, a male member is the same as the male member of the seventh embodiment (not shown in Figures). A female member 330 comprises a cover 331 having protrusions 332 at the inner side of each of the side walls, and the base 349 has concave portions 342 at the outer side of each of the side walls for receiving the protrusions 332. Thus, the base 340 and cover 331 are able to be attached without using a separate axle and can be formed as an open-close box by opening the cover 331 widely.

A coiled spring 348 is installed in the space inside the female member 330 formed of a recess in both the cover 331 and base 340 so as to be arranged in the up-down direction (it's not necessary that the coiled spring 348 is penetrated by an axle), and it biases the cover 331 and the base 340 toward the closing direction in the same manner as the above-mentioned embodiments.

In this embodiment, constructing the cover 331 and the base 340 becomes very simple and easy. Moreover, polishing the outer side of the female member 330 is not necessary in this embodiment because the bending axle does not protrude after the female member 330 is formed, unlike the embodiments mentioned above. Consequently, the connecting device of this embodiment may be more economical.

Figure 20:
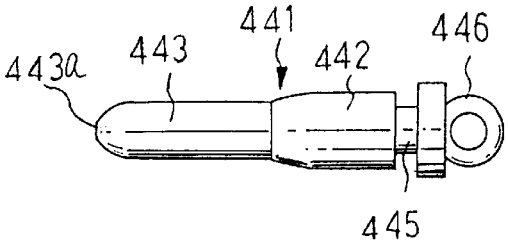
FIG. 20 is a side view showing the male member of a ninth embodiment of this invention.
Figure 21:
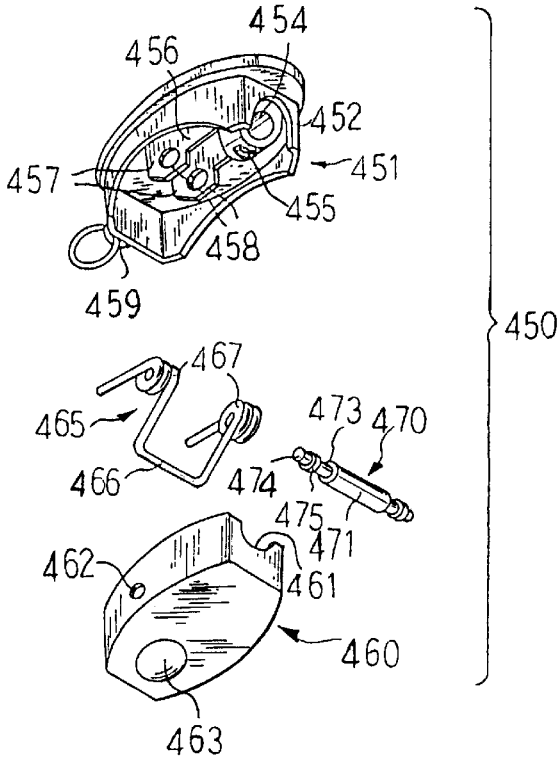
FIG. 21 is a perspective view showing the parts of the female member of the ninth embodiment of this invention.
Figure 22:
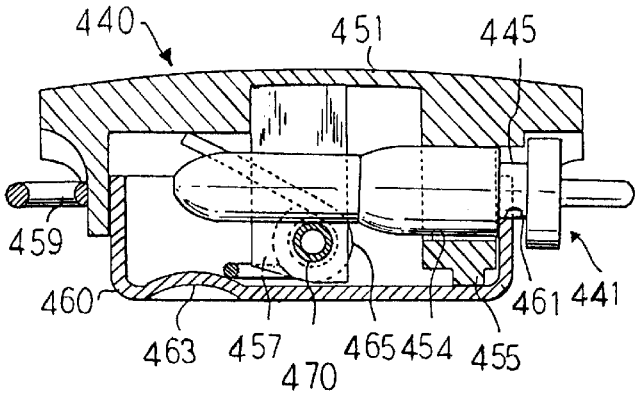
FIG. 22 is a cross sectional side view showing the connection of the ninth embodiment of this invention.
Figure 23:
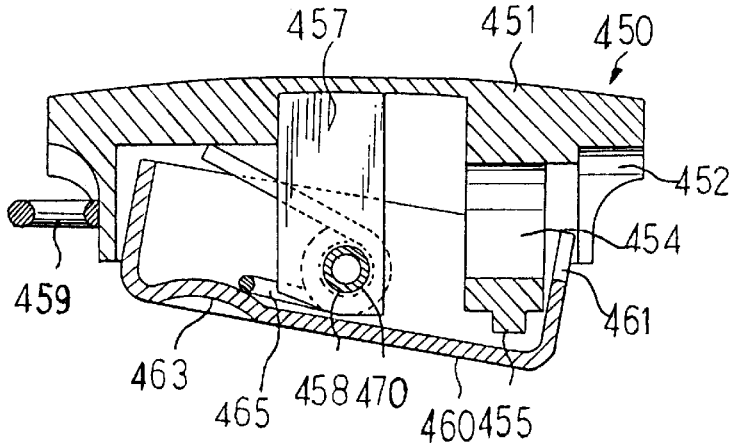
FIG. 23 is a cross sectional side view showing the female member of the ninth embodiment of this invention.
Figure 24:
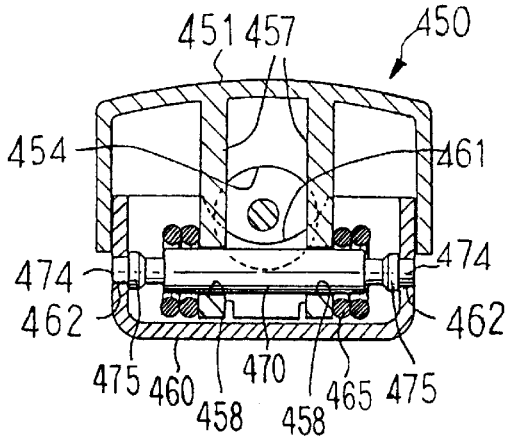
FIG. 24 is a cross sectional center view showing the female member of the ninth embodiment of this invention.
Figure 25:
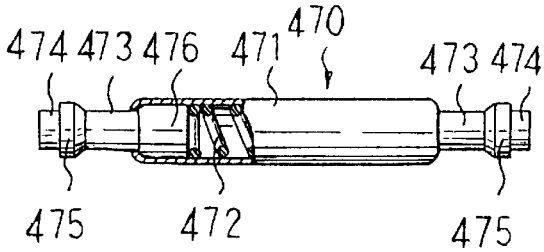
FIG. 25 is a partial cross sectional side view showing a spring axis of the ninth embodiment of this invention.

FIG. 20 is a side view showing the male member of a ninth embodiment of this invention, FIG. 21 is a perspective view showing the parts of the female member of the ninth embodiment of this invention, FIG. 22 is a cross sectional side view showing the connection of the ninth embodiment of this invention, FIG. 23 is a cross sectional side view showing the female member of the ninth embodiment of this invention, FIG. 24 is a cross sectional center view showing the connection of the ninth embodiment of this invention, and FIG. 25 is a partial cross sectional side view showing a spring axle of the ninth embodiment of this invention.

A male member 441 of this embodiment is comprises a main body having two different outer diameter 443,442 and a gently-sloping taper at the head 443*a*. A groove 445 is formed between the head and a large-diameter bottom portion. The male member 441 also has a ring-shaped connecting portion 446 which is substantially the same as in the above-mentioned embodiments.

The female member 450 comprises a cover 451, which is opened at a the entire undersurface of a substantially oval-shaped box, and a base 460, which is opened at its entire upper surface which has substantially the same shape and size as the cover 451. An open-close box is embodied by matching the cover 451 and the base 460 with a spring axle 470 (described later). An insertion aperture 452 is formed at one end wall of the cover 451, and a guide cylinder 454, guide walls 456 are aligned with aperture 452 at the inner surface of the cover 451. A notch 455 used for stability to push the base 460 is formed on cylinder 454. Projections 457 are formed by extending each guide walls 456 downwards, and through-holes 458 for the tube of the spring axle 470 are also formed in the middle of the projections 457. A connecting portion 459 having a ring-shape is formed substantially in the same manner as the above-mentioned embodiments. A hook-recess 461 is formed as a half circle substantially the same as in the above embodiments in the base 460. Through-holes 462 for insertion of the end of the spring axle 470 are formed in both side walls, and a press portion 463 is formed at the outer surface of the base 460. A coiled spring 465 is formed to have a U-shape substantially the same as the above-mentioned embodiments.

In FIG. 25, a spring axle 470 is shown, and the axle comprises a tube 471 and a pair of sliding rods 473 at each side, which are slidable. The sliding rods 473 have brims 475 which contact the through-holes 462 of the base 460. The sliding rod 473 is installed inside tube 471 with a small spring 472 which pushes the sliding rod 473 outward, and with a topping portion 476 which stops the sliding rods 473.

The female member 450 of this embodiment is formed by the following method. Firstly, the spring rod 470 is compacted by pushing the sliding rods 473 by fingers. Secondly, the through holes 458 of the cover 451, the through holes 462 of the base 460 and the coil spring 465 are lined up. Thirdly, the tube 471 of the spring axis 470 penetrates to the through holes 458 of the cover 451, and the end of the sliding rod 474 is put into the coiled spring 465 and the through holes 462 of the base 460.

The use of connecting and removing of the male member 441 and the female member 450 of this embodiment is substantially the same as in the above-mentioned embodiments.

This embodiment has many more advantages. For example, it's very low cost because the female member 450 is formed easily only by pushing the both ends of the spring axle 470 using fingers. Therefore, it is not necessary to bend the axis like the above-mentioned embodiments to polish the side walls of the female member after the open-close box is formed. Naturally, the connecting device 440 of this embodiment may be very economical. Also, the replacement of the parts of the connecting device 440 of this embodiment is very easy because overhauling the female member 50 is done by compacting a spring axle through the through holes of both sides of base 460 using a jewelry tool such as a pin point. Therefore, any jeweler can repair the connection device without having special facilities.

Figure 26:
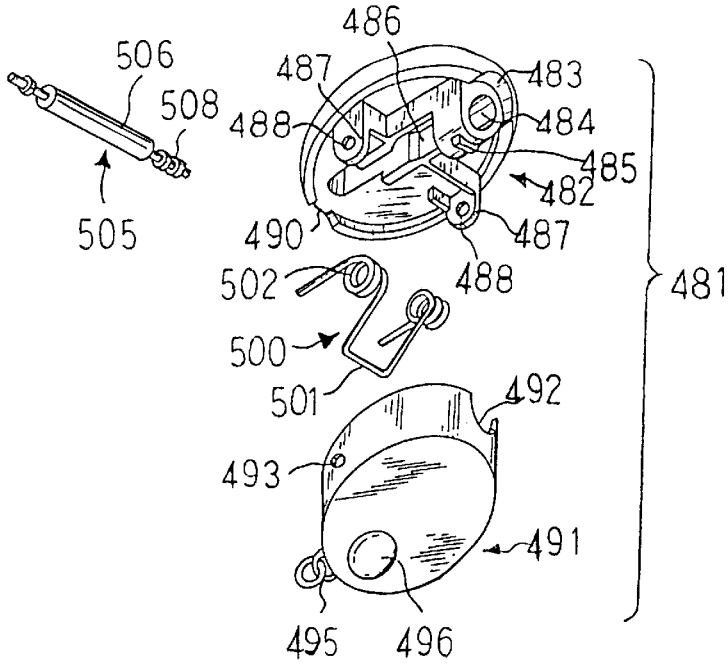
FIG. 26 is a perspective view showing parts of a female member of a tenth embodiment of this invention.
Figure 27:
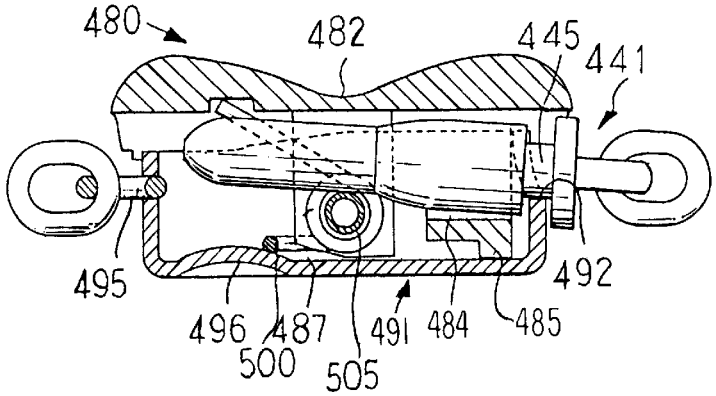
FIG. 27 is a cross sectional view showing the connection of the male member and the female member of the tenth embodiment of this invention.
Figure 28:
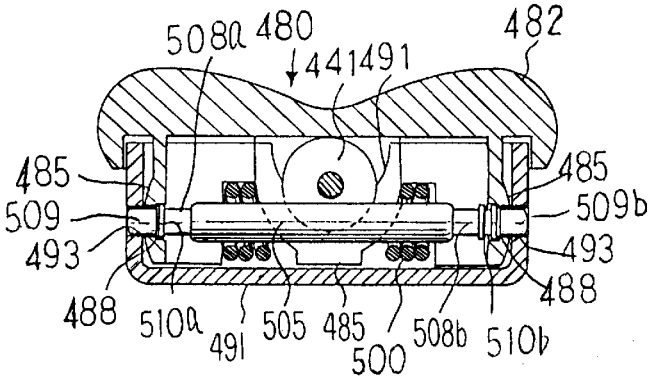
FIG. 28 is a cross sectional center view of the female member of the tenth embodiment of this invention.
Figure 29:
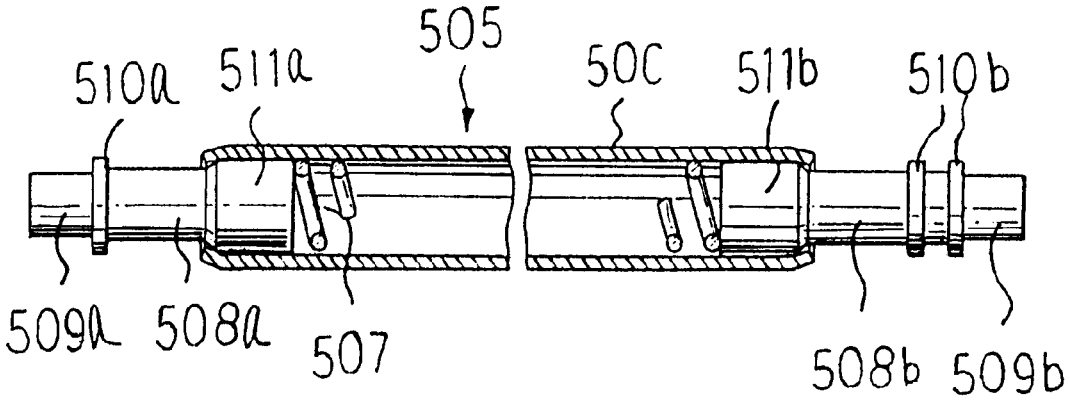
FIG. 29 is a partial cross sectional side view showing a spring axis of the tenth embodiment of this invention.

FIG. 26 is a perspective view showing parts of a female member of a tenth embodiment of this invention, FIG. 27 is a cross sectional view showing the connection of the male member and the female member of the tenth embodiment of this invention, FIG. 28 is a cross sectional center view of the female member of the tenth embodiment of this invention, and FIG. 29 is a partial cross sectional side view showing a spring axle of the tenth embodiment of this invention.

The male member of this embodiment is substantially the same as the ninth embodiment.

A female member 481 comprises a cover 482 which is opened at the entire undersurface of a substantially oval-shape box, and a base 491 which is opened at the entire upper surface of a substantially oval-shape box. They are attached by a spring axle 506, and an open close box is formed in the same manner as the above-mentioned embodiments. An insertion concave portion 483 is formed at one side of the cover 482, and a guide cylinder 484 is aligned with the insertion concave portion 483 on an inner upper surface of the cover 482. A notch 485 used for stability and pushes the base 491 when the open-close box is formed. Wide projections 487 extend from the guide cylinder 483, and through-holes 488 for the spring axle 505 are formed therein. A hook-recess 492 of a half circle shape, through holes 493 and a connecting portion 495 are formed in base 491 in substantially the same manner as the ninth embodiments in the base 491. A coiled spring 500 is formed in the same manner as the above-mentioned embodiments. A spring axle 505 of this embodiment comprises a tube 506 and a pair of sliding rods 508 and 509 which are installed in the tube 506 with a small spring 507, and the sliding rods 508, 509 are slidable in the same manner as the eighth embodiment.

The sliding rod 508 has one brim and the sliding rod 509 has two brims that both contact the through holes 488 of the projections 487. The end of the spring rod 508, 509 is inserted in the through holes 493 of the base 491.

The use of this embodiment is substantially the same as the ninth embodiment.

In this embodiment, the sliding rod 509 has two brims and therefore it is easy to release the spring axis 505 from the through holes 488 of the wide projections 487 of the cover 482 by touching the inner side brim of the sliding rod 508 by a jewelry tool.

In addition, the wide projections 487 of the cover 482 and the through holes 493 of the base 491 are penetrated by the sliding rods 508. Thus, the cover 482 and the base 491 are supported by the same rod of the sliding axle 505 (On the other hand, the cover is supported by the tube, and the base is supported by the sliding rod in the ninth embodiment). Therefore, the opening/closing operation is smooth and the cover 482 and the base 491 are fixed with stability.

Figure 30:
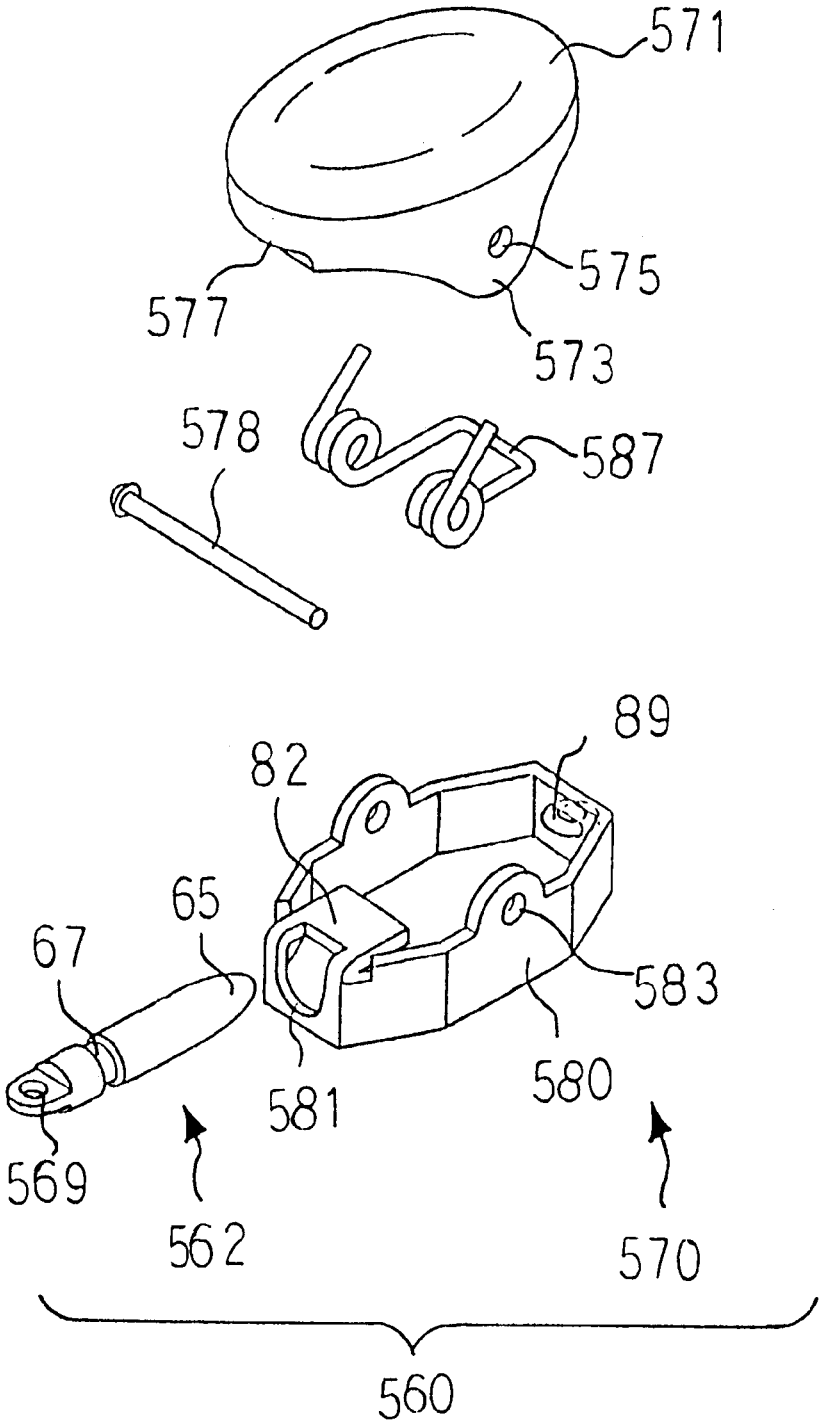
FIG. 30 is a perspective view showing parts of a connecting device of an eleventh embodiment of this invention.

FIG. 30 is a perspective view showing parts of a connecting device of an eleventh embodiment of this invention.

In this embodiment, the female member 570 is formed to have a supporting wall 82 which is made only by bending the extended end wall of the base 580, and does not have guiding cylinders or guiding walls at all as the above-mentioned embodiments.

Not only this embodiment, but all the embodiments in this invention may be formed without having the guiding cylinder or guiding walls. The male member is inserted into the space in the female member. For instance, it is held fly in the space formed by the middle of the u-shape of the coiled spring. The connecting device for Jewelry and accessories of this invention may be produced even more economical in this embodiment.

According to the connecting device for jewelry and accessories of this invention, the connection of the male member and the female member is accomplished only by inserting the head of the male member from the inserting aperture of the female member and pushing deeply. Also, the disconnection is accomplished only by pushing the press portion of the base of the female member, so the operation becomes very easy. Moreover, since the structure of the connecting device of this invention is simple, the cost of the product is very reasonable.

It should be understood that the foregoing relates to only preferred embodiments of the present invention, and that it is intended to cover all changes and modifications of the embodiments of the invention herein used for the purpose of the disclosure, which do not constitute departures from the spirit and scope of the invention.

What is claimed is:

1. A connection device for jewelry, comprising:

an elongated male member having a tapered front end, a rear end, a circumferential groove adjacent to said rear end, and a connecting portion at said rear end for connecting said male member to jewelry;

a female member formed as a box operable to open and close, said female member including:

a cover having one of a half-circle-shaped aperture and a recess at a longitudinal first end for receiving said male member;

a base having a hook recess at a longitudinal first end for receiving said groove of said male member; and a connecting portion at a longitudinal second end of one of said cover and said base for connecting said female member to jewelry;

a spring axle extending through said cover and said base so as to pivotally connect said cover and said base, said spring axle including:

a tube having a first open end and a second open end;

a spring inside said tube;

a first sliding rod slidably extending through said first open end such that a distal end of said first sliding rod extends outside said first open end of said tube; and a second sliding rod slidably extending through said second open end such that a distal end of said second sliding rod extends outside said second open end of said tube, said spring being arranged in said tube so as to bias said first sliding rod and said second sliding rod in an outward direction; and a spring member for biasing said cover and said base in a direction so as to close said female member and wherein said cover includes a pair of parallel guide walls extending from an inner upper surface thereof, each of said guide walls having a through-hole, said spring axle being arranged such that said tube extends through said through-hole of each of said guide walls.

2. The connection device of claim 1, wherein said base has a first sidewall and a second sidewall, each sidewall having a through-hole formed therein, said spring axle being arranged in said female member such that said distal end of said first sliding rod extends through said through-hole in said first sidewall, and such that said distal end of said second sliding rod extends through said through-hole in said second sidewall.

3. The connection device of claim 2, wherein said distal end of said first sliding rod has a circumferential brim abutting an inner surface of said first sidewall, and said distal end of said second sliding rod has a circumferential brim abutting an inner surface of said second sidewall.

4. The connection device of claim 2, wherein said cover includes a first extension wall and a second extension wall extending from an inner upper surface of said cover, each of said extension walls having a through-hole, said spring axle being arranged such that said distal end of said first sliding rod extends through said through-hole of said first extension wall, and such that said distal end of said second sliding rod extends through said through-hole of said second extension wall.

5. The connection device of claim 4, wherein said distal end of said first sliding rod has a circumferential brim abutting an inner surface of said first extension wall, and said distal end of said second sliding rod has a first circumferential brim abutting an inner surface of said second extension wall and a second circumferential brim axially spaced from said first circumferential brim.

6. The connection device of claim 5, wherein said cover further includes a guide cylinder having an inner diameter substantially equal to a diameter of said male member.

7. The connecting device of claim 1, wherein said guide walls are spaced apart a distance equal to a diameter of said male member.

8. The connection device of claim 1, wherein said male member includes a plurality of connecting portions at said rear end, and said female member includes a plurality of connecting portions at a longitudinal second end of one of said cover and said base.

9. The connection device of claim 1, wherein said base of said female member comprises a hook lever having a width smaller than a width of said cover.

10. A connection device for jewelry, comprising:

a male member having a front end, a rear end, a hook portion, and a connecting portion at said rear end for connecting said male member to jewelry;

a female member formed as a box operable to open and close, said female member including:

a cover having a recess at a longitudinal first end for receiving said male member, and having a first sidewall and a second sidewall extending downward from a bottom surface of said cover, said first sidewall having a first protrusion extending from an inner surface thereof, said second sidewall having a second protrusion extending from an inner surface thereof;

a base having a hook at a longitudinal first end for receiving said hook portion of said male member, having a first concave portion at a first side for receiving said first protrusion, and having a second concave portion at a second side for receiving said second protrusion, said cover and said base being arranged such that said base is operable to pivot with respect to said cover about said first protrusion and said second protrusion; and a connecting portion at a longitudinal second end of one of said cover and said base for connecting said female member to jewelry; and a spring member for biasing said cover and said base in a direction so as to close said female member wherein said spring member comprises a coil compression spring having a longitudinal axis arranged orthogonal to a longitudinal axis of said female member.

11. The connection device of claim 10, wherein said male member includes a plurality of connecting portions at said rear end, and said female member includes a plurality of connecting portions at a longitudinal second end of one of said cover and said base.

12. The connection device of claim 10, wherein said base of said female member comprises a hook lever having a width smaller than a width of said cover.

13. The connection device of claim 10, wherein said male member has a rounded head at said front end, and said hook portion of said male member comprises a hook hole.

14. A connection device for jewelry, comprising:

an elongated male member having a tapered front end, a rear end, a circumferential groove adjacent to said rear end, and a connecting portion at said rear end for connecting said male member to jewelry;

a female member formed as a box operable to open and close, said female member including:

a cover having one of a half-circle-shaped aperture and a recess at a longitudinal first end for receiving said male member, wherein said cover further includes a guide cylinder having an inner diameter substantially equal to a diameter of said male member;

a base having a hook recess at a longitudinal first end for receiving said groove of said male member; and a connecting portion at a longitudinal second end of one of said cover and said base for connecting said female member to jewelry;

a spring axle extending through said cover and said base so as to pivotally connect said cover and said base, said spring axle including:

a tube having a first open end and a second open end;

a spring inside said tube;

a first sliding rod slidably extending through said first open end such that a distal end of said first sliding rod extends outside said first open end of said tube; and a second sliding rod slidably extending through said second open end such that a distal end of said second sliding rod extends outside said second open end of said tube, said spring being arranged in said tube so as to bias said first sliding rod and said second sliding rod in an outward direction; and a spring member for biasing said cover and said base in a direction so as to close said female member.

* * * * *